United States Patent [19]

Avery

[11] 4,290,804

[45] Sep. 22, 1981

[54] METHOD FOR PRODUCING MAGNESIUM

[76] Inventor: Julian M. Avery, 47 Old Orchard Rd., Chestnut Hill, Mass. 02167

[21] Appl. No.: 124,706

[22] Filed: Feb. 26, 1980

[51] Int. Cl.[3] ..... C22B 45/00

[52] U.S. Cl. ..... 75/67 R; 75/10 R

[58] Field of Search ..... 75/67 A, 67 R, 10 R

[56] References Cited

U.S. PATENT DOCUMENTS 2,381,403 8/1945 Chisholm ..... 75/67 A 2,381,405 8/1945 Griswold, Jr. ..... 75/67 A

*Primary Examiner*—M. J. Andrews

*Attorney, Agent, or Firm*—Paul J. Cook

[57] ABSTRACT

Magnesium is recovered from a superheated gaseous mixture comprising essentially carbon monoxide gas and magnesium vapor by shock-cooling the vaporous composition with a spray of liquid magnesium preferably heated to a temperature near its vaporization temperature. The liquid magnesium is instantly vaporized with a large absorption of high temperature heat and the vaporous mixture is thereby cooled to a temperature somewhat above the vaporization temperature of magnesium. The resultant vaporous magnesium is recovered by condensation to produce a molten magnesium product.

9 Claims, 2 Drawing Figures

METHOD FOR PRODUCING MAGNESIUM

BACKGROUND OF THE INVENTION

This invention relates to a carbothermic process for producing magnesium from magnesium oxide. More particularly, the present invention provides means for greatly decreasing the back-oxidation of magnesium vapor by carbon monoxide as the furnace gases are cooled, which has heretofore prevented successful commercial development of a carbothermic magnesium process.

It has long been recognized among those skilled in the art that production of magnesium from magnesium oxide by reduction with carbon in an arc furnace is theoretically the most efficient and cheapest method for the commercial production of magnesium. In particular, it offers many advantages over metallothermic processes where a reducing agent such as silicon or aluminum requires an expensive preliminary operation requiring electric energy. In a carbothermic process, the magnesia-containing raw material is subjected to high temperature reduction by carbon in an arc furnace. The product initially produced comprises a vaporous composition which is theoretically approximately a 50—50 mixture of magnesium vapor and carbon monoxide gas. Thermodynamic calculations for the reaction show that the theoretical reaction equilibrium temperature at atmospheric pressure is about 1875° C. and in order to carry out the reaction at a reasonable rate, it is has been found necessary to operate at temperatures on the order of 2000° C. This thermodynamic constraint is undesirable since it causes extreme difficulty in cooling the furnace gases down to the equilibrium temperature of about 1875° C., rapidly enough to prevent excessive back oxidation of magnesium by reaction with carbon monoxide to form magnesium oxide. The reaction in question, which is reversible as shown, $$\text{Ti } MgO + C \rightleftharpoons Mg + CO$$

reaches equilibrium at about 1875° C. at atmospheric pressure of the CO, proceeds violently toward oxidation of magnesium if the gaseous mixture of Mg and CO is cooled below that temperature and above 1875° C. to the operating temperature. Above 2000° C., the reaction proceeds rapidly to the right to effect substantially complete reduction of the magnesium oxide to form magnesium vapor and carbon monoxide.

On the other hand, I have found that at temperatures below about 1875° C., the rate of back oxidation of magnesium vapor by carbon monoxide decreases rapidly with the temperature to such an extent that the reaction rate at 1500° C. is less than 1% of the rate at the equilibrium temperature of 1875° C. and at a temperature of 1100° C. a little above the dew-point, substantially no back oxidation of magnesium occurs provided the magnesium vapor is condensed quickly.

Prior attempts to cool the reaction product from the carbothermic reaction comprising magnesium and carbon monoxide down to the temperature where back oxidation becomes insubstantial have proven unsuccessful. It has been proposed to utilize a wide variety of coolants including methane gas, solid powdered magnesium and a stream of relatively cool (650° C.-670° C.) liquid magnesium. While it has been proposed to utilize these coolants in amounts sufficient to extract the heat necessary to cool the vaporized magnesium down to the point where insubstantial back oxidation occurs, each approach has proven unsuccessful since the cooling obtained is too slow. That is, each of these approaches effects a rate of cooling such that the vaporized magnesium experiences a substantial residence time within the temperature range of between about 1875° C. and 1500° C. Since, during the residence time between 1875° C. and 1500° C. the vaporized magnesium is an intimate contact with carbon monoxide, substantial back oxidation occurs to an extent as to render these processes uneconomical and commercially unfeasible.

It would be highly desirable to provide a carbothermic process for forming magnesium from magnesium oxide wherein vaporized magnesium can be recovered without substantial back oxidation. Furthermore, it would be highly desirable to provide such a process wherein the residence time for vaporized magnesium product in contact with carbon monoxide within the temperature range of 1875° C. and about 1500° C. is minimized. Furthermore, it would be highly desirable to provide such a process wherein substantially pure magnesium is recovered directly from the vaporous product gas.

SUMMARY OF THE INVENTION

The present invention provides a process for cooling a vaporous product containing carbon monoxide and vaporous magnesium down to a temperature where there is little or no reaction of the magnesium with carbon monoxide. In addition, the present invention provides a means for cooling vaporous magnesium sufficiently rapidly as to allow the use of carbothermic process wherein the magnesium vapor is produced from a magnesia-containing feed and a carbonaceous reducing agent in the presence of an electric arc generated by electrodes. The means for cooling the vaporous magnesium comprises liquid magnesium having a temperature close to the vaporization temperature of magnesium in sufficient amounts as to cool the vaporous magnesium down to the magnesium vaporization temperature of about 1100° C. substantially instantaneously. This means of cooling can be supplemented by introducing inert gas in admixture with the vapor containing vaporous magnesium. Furthermore, this method can be supplemented by a second cooling step following cooling with liquid magnesium whereby a flux for magnesium is sprayed into the vaporous magnesium for intimate contact therewith.

DESCRIPTION OF SPECIFIC EMBODIMENTS

Figure 1:
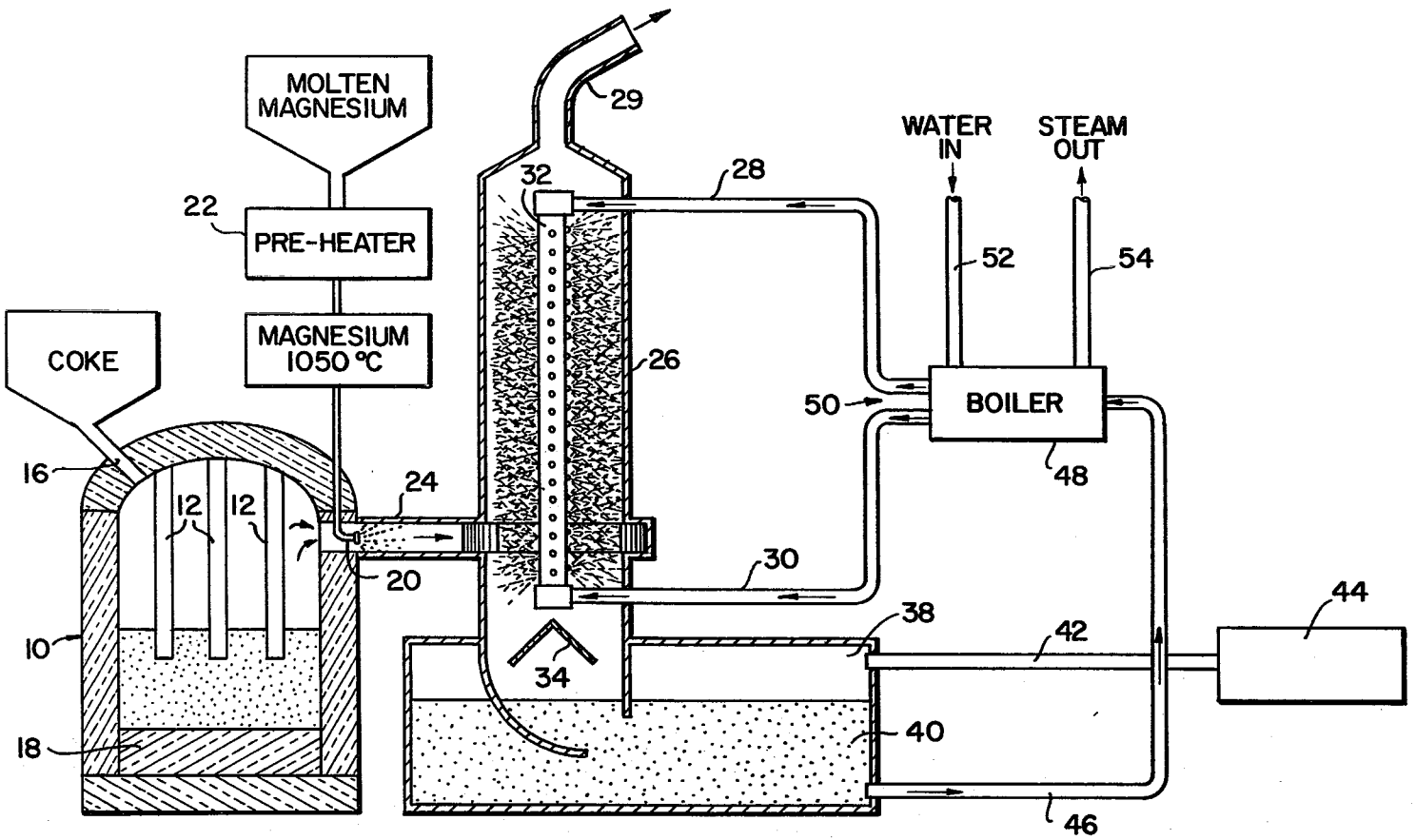
FIG. 1 is a schematic view of one embodiment of this invention.

As shown in FIG. 1, the process of this invention utilizes a furnace 10 having electrodes 12 which extends into the reaction bed 14 which is comprised mainly of magnesium oxide and a carbonaceous reducing material such a coke. The magnesium oxide and coke are introduced into the furnace 10 by means of conduit 16 which also is provided with means for closing the conduit to the atmosphere during reaction. The reaction bed 14 rests on hearth 18. When it is desired to initiate and maintain reaction in the reaction bed, electric arcs are generated between the electrodes 12 in order to effect reaction between magnesium oxide and the carbon to for magnesium vapor and carbon monoxide. During reaction, the vaporous composition comprising magnesium and carbon monoxide rises towards the top of the furnace and exits there from through opening 20. At the entrance 20, the vaporous composition generally is a temperature between about 2200° C. and about 1900° C. Thus, the temperature of the vaporous composition is within a sufficiently elevated range such that there is little or no back reaction between the vaporous magnesium and the carbon monoxide. Before the magnesium-carbon monoxide vaporous composition is cooled to a temperature below about 1900° C., it is contacted with molten-magnesium which is heated to a temperature between about 800° C. and 1100° C., preferably between about 1000° C. and about 1100° C. in heater 22 and thereafter is introduced into opening 20 for intimate contact therein with the vaporous composition. In order to afford intimate contact between the liquid magnesium and the vaporous composition, the liquid magnesium is introduced as a spray. Furthermore, the liquid magnesium is introduced under conditions such that substantially all of the liquid magnesium is vaporized while minimizing the temperature to which the vaporized magnesium as subsequently heated by the vaporous composition of magnesium and carbon monoxide. By operating in this manner, substantial advantages are obtained as compared to the prior art proposals wherein cooling was effected with liquid magnesium in a relatively cooled conditions, e.g., 650° C. to 670° C. By operating in the manner described herein, the amount of heat extracted from the vaporous composition of magnesium and carbon monoxide is substantially equal to the heat of vaporization of the introduced liquid magnesium rather than relying solely upon reduction by transfer of sensible heat from the vaporous composition to the liquid magnesium. By utilizing the heat of vaporization to cool the vaporous composition as described herein, the vaporous composition removed from the furnace 10 is reduced in temperature to about the magnesium dew point, i.e., below about 1500° C., preferably below about 1100° C. and more preferably between about 1050° C. and 1150° C. substantially instantaneously. In contrast, prior art techniques utilizing low temperature liquid magnesium do not provide the desired substantial instantaneous reduction in temperature of the vaporous composition since these techniques rely upon a rise in the sensible heat of the liquid magnesium coolant which provides of far slower rate of heat extraction than the technique utilized in the present invention which relies upon the heat of vaporization of the liquid magnesium. Accordingly, the present invention provide a procedure wherein the temperature of the liquid magnesium is reduced from a high temperature range within which substantially no back reaction between carbon monoxide and magnesium is effected to a substantially lower temperature range wherein little or no back reaction of magnesium vapor occurs. The magnesium having a temperature within this lower temperature range then can be cooled at a slower rate utilizing transfer of sensible heat so as to condense and recover the magnesium.

The vaporous composition resulting from the initial cooling step is passed from opening 20 through conduit 24 into scrubbing tower 26. Within scrubbing tower 26, the vaporous composition comprising magnesium and carbon monoxide is contacted with a molten flux composition for magnesium such as a conventional magnesium chloride composition.

TABLE

| | Typical Flux Compositions (by weight)* | | | | | |
|---|---|---|---|---|---|---|
| Example | 1 | 2 | 3 | 4 | 5 | 6 |
| $MgCl_2$ | 22 | 10 | — | 40 | 15 | 10 |
| $CaCl_2$ | 23 | 40 | 50 | 25 | 25 | 40 |
| NaCl | 54 | 30 | 30 | 20 | 40 | 20 |
| KCl | — | 20 | 20 | 15 | 20 | 30 |
| alkaline earth chlorides | 45 | 50 | 50 | 65 | 40 | 50 |
| alkali metal chlorides | 54 | 50 | 50 | 35 | 60 | 50 |

*Other components, such as $CaF_2$, LiF, or MgO may be present. See generally, for discussion of suitable flux compositions, Principles of Magnesium Technology, E. F. Ensley, ed., Pergammon Press (London, 1966), pp. 27-33, 76-78, 84-125.
Note Flux #1 has a melting point below 400° C. and high fluidity.

As well known, the flux composition is utilized to separate impurities such as unreacted magnesium oxide from the magnesium. Product gas rich in carbon monoxide and containing little or no magnesium is removed from scrubbing tower 26 through conduit 29. As shown in FIG. 1, molten flux enters scrubbing tower 26 through conduit 28 and 30 and from there passed into conduit 32 which is provided with a plurality of spray nozzles. Generally, the molten flux has a temperature of usually between 400° C. and 500° C. in order to effect further temperature reduction of the vaporous magnesium so that it is condensed to form a liquid. The liquid magnesium and molten flux pass downwardly through the scrubbing tower 26 to contact baffle 34 from which the liquid flows into container 36. In container 36, the liquid magnesium separates into a top strata 38 floating on a bottom strata 40 which comprises the flux. Typical equilization temperatures within container 36 for the magnesium and the molten flux is between about 700° C. and 750° C. The liquid magnesium is drawn out through conduit 42 for further processing such as in a foundry 44 to form magnesium ingots. The molten flux 40 is drawn off through conduit 46 to heat exchanger 48 so that the flux can be cooled to a desired temperature and passed through conduit 50 and conduits 28 and 30 for further use for contact with the vaporous magnesium. In the heat exchanger 48, the flux is cooled such as by conventional heat exchange with water which enters heat exchanger 48 through conduit 52 and leaves heat exchanger 48 as stream throught conduit 54.

Figure 2:
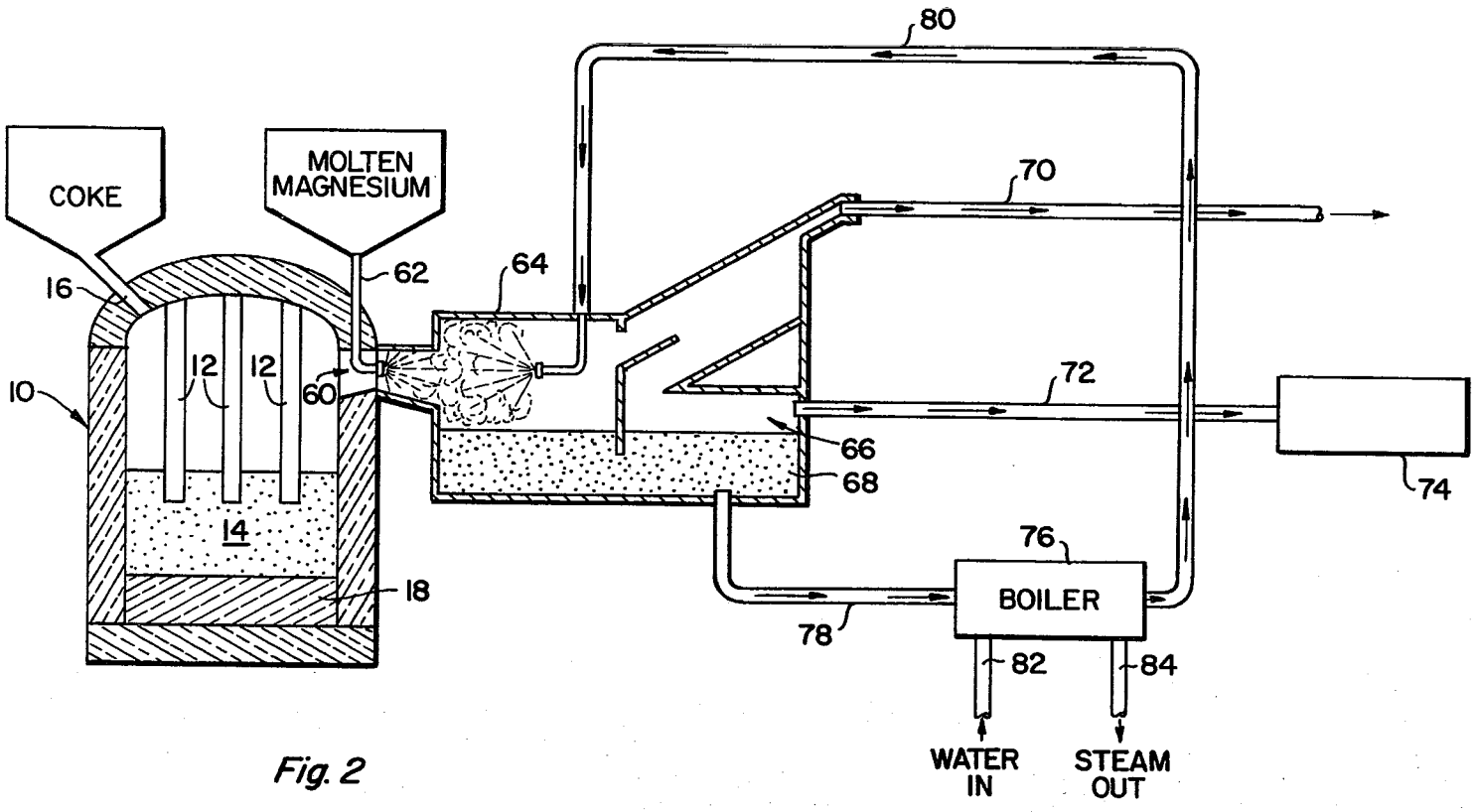
FIG. 2 is a schematic view of second embodiment of this invention.

Referring to FIG. 2, the process of this invention as shown schematically without the use of a scrubbing tower. The process utilizes reactor 10 which is provided with the electrodes 12. The coke and magnesium oxide reactants are introduced into reactor 10 through opening 16 to form a reaction bed 14. The reaction bed 14 rest upon hearth 18. When it is desired to effect reaction between the coke and the magnesium oxide at a temperature between about 1900° C. and 2200° C., electrical power is supplied to the electrodes 12 to cause arcing between them. The vaporous reaction product comprising magnesium and carbon monoxide rises from the reaction bed 14 and exits the reactor 10 through opening 60. The vaporous composition exiting the reactor 10 has a temperature about 1900° C. and about 2200° C., i.e., a temperature range wherein little or no back reaction of the carbon monoxide and magnesium occurs. This vaporous composition is contacted with molten magnesium which enters the opening 60 through conduit 62 at a temperature near its vaporization temperature as explained above prior to permitting the vaporous reaction composition to cool within a temperature range of which substantial back reaction of magnesium and carbon monoxide occurs. As stated above, the contact of the vaporous reaction composition and the molten magnesium effects a temperature reduction of the vaporous composition to allow about 1500° C. and preferably about the magnesium dew point, i.e. below about 1100° C. The resultant of vaporous composition containing magnesium and carbon monoxide enters spray chamber 64 within which it is contacted with a spray of molten flux which has the effect of scavenging impurities from the magnesium product and effects condensation of the magnesium vapor to magnesium liquid. The magnesium liquid forms a floating layer 66 on the liquid flux 68. Generally, the temperature of the liquid flux and liquid magnesium is between about 700° C. and 750° C. The uncondensed carbon monoxide is removed from chamber 64 through conduit 70 for further used as desired such as a fuel. The liquid magnesium is removed from the magnesium layer 66 through conduit 72 for further processing such as to form ingots in a foundry 74. The molten flux 68 is directed to heat exchanger 76 by means of conduit 78 wherein it is cooled to a temperature between about 400° C. and 700° C. for recycle by means of conduit 80 to spray chamber 64. Any conventional heat exchanger 76 can be utilized, for example, one utilizing cool water entering through conduit 82 and from which steam is removed through conduit 84.

I claim:

1. The process for recovering magnesium from a vaporous composition comprising magnesium and carbon monoxide, said composition having a temperature above the temperature at which substantial reaction of magnesium and carbon monoxide occurs which comprises contacting said vaporous composition with liquid magnesium heated to a temperature between about 800° C. and 1100° C. so as to vaporize a substantial portion of said liquid magnesium and to reduce the temperature of said vaporous composition to below about 1500° C. substantially instantaneously in order to minimize back oxidation of magnesium with carbon monoxide and subsequently cooling said vaporous composition to condense said magnesium.

2. The process of claim 1 wherein said liquid magnesium has a temperature between about 1000° C. and 1100° C.

3. The process of claim 1 wherein the vaporous composition is contacted with a liquid flux composition for magnesium subsequent to contacting said vaporous composition with liquid magnesium thereby to condense vaporous magnesium.

4. The process of claim 1 wherein an inert gas is admixed with said vaporous composition prior to admixing said vaporous composition with liquid magnesium, said inert gas having a temperature above the temperature at which substantial reaction of magnesium and carbon monoxide in admixture occurs.

5. The process of claim 1 wherein an inert gas is admixed with said vaporous composition subsequent to contacting said vaporous composition with liquid magnesium.

6. The process of claim 3 wherein said molten flux comprises magnesium chloride.

7. The process for recovering magnesium from a vaporous composition comprising magnesium and carbon monoxide, said composition having a temperature above the temperature at which substantial reaction of magnesium and carbon monoxide occurs which comprises contacting said vaporous composition with a spray of liquid magnesium having a temperature between about 800° C. and 1100° C., said contacting effective to vaporize substantially all of said liquid magnesium and to cool said vaporous composition to below about 1500° C. and contacting said vaporous composition having a reduced temperature with a molten flux composition for magnesium in order to condense said magnesium.

8. The process of claim 7 wherein a inert gas is admixed with said vaporous composition prior to admixing said vaporous composition with liquid magnesium, said inert gas having a temperature about 1900° C.

9. The process of claim 7 wherein an inert gas is admixed with said vaporous composition subsequent to contacting said vaporous composition with liquid magnesium.

* * * * *